US006499264B2

(12) United States Patent
Swapp

(10) Patent No.: US 6,499,264 B2
(45) Date of Patent: Dec. 31, 2002

(54) WINDOW SHUTTER

(76) Inventor: Ronald Larry Swapp, PMB-618 11445 E. Via Linda #2, Scottsdale, AZ (US) 85259

( * ) Notice: Subject to any disclaimer, the term of this patent is extended or adjusted under 35 U.S.C. 154(b) by 0 days.

(21) Appl. No.: 09/839,387

(22) Filed: Apr. 20, 2001

(65) Prior Publication Data

US 2002/0152689 A1 Oct. 24, 2002

(51) Int. Cl.[7] ..... B44F 7/00
(52) U.S. Cl. ..... 52/312; 49/504; 160/236
(58) Field of Search ..... 52/312, 717.01, 52/211; 49/74.1, 92.1, DIG. 2, 504; 160/236, 31

(56) References Cited

U.S. PATENT DOCUMENTS 314,833 A * 3/1885 Harsha ..... 52/312
439,912 A * 11/1890 Ward ..... 49/74.1
1,927,882 A * 9/1933 Willnus ..... 52/312
4,719,955 A * 1/1988 Tachikawa et al. ..... 160/168 R
4,948,206 A * 8/1990 Fitzpatrick ..... 312/296
5,029,628 A * 7/1991 Lemay ..... 160/168.1 V
5,304,412 A * 4/1994 Wang ..... 428/174
5,379,551 A * 1/1995 Swapp ..... 49/74.1
5,444,956 A * 8/1995 Searer et al. ..... 52/312
5,572,831 A * 11/1996 Rafiqui ..... 49/92.1
5,778,598 A * 7/1998 Ohanesian ..... 49/74.1
6,244,001 B1 * 6/2001 Anastasi ..... 49/504

FOREIGN PATENT DOCUMENTS

FR 2.165.786 * 8/1973

* cited by examiner

*Primary Examiner*—Jerry Redman
(74) *Attorney, Agent, or Firm*—Gregory J. Nelson

(57) ABSTRACT

A window shutter frame defining a recess in which various selected decorative strips may be inserted. The shutter frame also carries a flexible flap so the frame may be pre-manufactured and installed in window recess or other installation location which are not dimensionally accurate without the necessity of cutting and trimming. Preferably the frame components are extruded from synthetic polymeric material.

4 Claims, 2 Drawing Sheets

WINDOW SHUTTER

FIELD OF THE INVENTION

The present invention relates to window shutters and more particularly to window shutters and components fabricated at least partially from synthetic materials and having features which facilitate installation and provide decorative versatility.

BACKGROUND OF THE INVENTION

Various interior window treatments are utilized both in residential and commercial buildings. One widely used and accepted window treatment is the shutter. Shutters are popular because of their pleasing aesthetic appearance, versatility, adjustability and functional advantages. A functional advantage of shutters is that the shutter's louvers can be positioned to change the desired light level and also to deflect light and reduce glare. Shutters also serve to reduce heat load transferred to the interior area through a window opening. Shutters can be manufactured to fit into window openings having a wide variety of sizes and shapes. Shutters in the past have been primarily made of wood and are fabricated and assembled off-site and then installed at the installation location. Generally wooden shutters are stained or painted.

As indicated above, conventional shutters are manufactured of wood. The stiles and rails are planed, shaped, drilled and routed in the assembly process. Wooden louvers are similarly formed and assembled as part of the structure. If the louvers are of the adjustable type, the louvers are provided with dowels or pivot pins, which are inserted into the vertical edges of the stiles. Subsequent to assembly, the shutters are generally finished by coating with either a stain, varnish or paint. While conventional shutters are widely used and are suitable to many applications, wooden shutters in some instances may be subject to warpage and discoloration as a result of the environment in which they are installed being subject to both heat and light.

As a result of the environmental conditions to which shutters are subjected and further reduce the cost of manufacture, shutters may also be formed of suitable synthetic polymeric materials. Materials such as polyvinylchloride, polystyrene, polyurethane, polypropylene are often used. One such material is the material sold under the trademark Polywood® by Sunburst Shutters of Phoenix, Ariz. The louvers are support on opposite stiles by pivot pins. The louvers are supported on pivot pins. The assembly and fabrication involves the steps of molding the rail and stile components, installing the louvers on pivot pins or dowels and completing the frame structure in which the panel is installed. Painting or staining in not generally necessary as the polymeric material includes a suitable colorant. Shutters made of polymeric materials have distinct advantages in terms of durability, reduced warpage and ease of fabrication, such shutters do not provide the customer with a variety of decorative features from which the customer can select. However, shutter assemblies fabricated from synthetic materials do not lend themselves to shaping, cutting and trimming operations at the point of installation and inasmuch as extruded sections are provided with an external smooth skin which, if removed, will expose a rougher more porous core.

Accordingly, there exists a need for a shutter assembly which provides the customer a number of aesthetic decorative options from which the customer can select. Further, there exists a need for a shutter assembly which can be easily installed without requiring cutting or trimming and which when installed will provide a tight seal against the window frame or recess in which it is installed.

SUMMARY OF THE INVENTION

Briefly, the present invention provides a window shutter assembly having an exterior frame which supports at least one louver panel with vertical stiles and horizontal rails. The louver panel is hinged so it may open or close. A plurality of louvers, which may be fixed or pivotal, are arranged in parallel fashion and joined at their opposite ends to the edges of the vertical stiles. The exterior frame, in which the louver panel is mounted, defines one or more channels or recesses extending in the surface of the frame. The channels are adapted to receive a decorative insert. The surface of the decorative strip carries suitable design features. One or more surfaces of the louvers may also be provided with a matching or compatible design features. The design features on the surfaces of the louvers are applied by embossing on the surface subsequent to the extrusion operation.

The exterior frame member, which extends around the louver panels, has a generally L-shaped configuration with a rearwardly depending leg section and a facing section which extends around the louver panel. In a normal installation, the rearwardly depending leg extends into the opening such as the perimeter area around a window into which the shutter assembly is installed. To facilitate installation with little or no cutting or trimming necessary, the rearwardly depending leg of the frame is provided with a flexible flap which abuts and seals against the edges of the opening providing a dust-free, neat installation. The flap also provides a clearance space with respect to the opening to facilitate installation without the necessity of trimming.

Accordingly, the shutter assembly, including the frame and louver panel, may be fabricated and assembled at the factory and installed with little or no trim work required at the installation site. Decorative trim features can be installed either at the factory or at the time of installation. While the components may be fabricated from wood, it is preferred that the frame, insert and panel components be fabricated by techniques such as extrusion and embossing using synthetic polymeric materials.

BRIEF DESCRIPTION OF THE DRAWINGS

The above and other objects and advantages will become more apparent from the following description, claims and drawings in which:

DETAILED DESCRIPTION OF THE DRAWINGS

Figure 1:
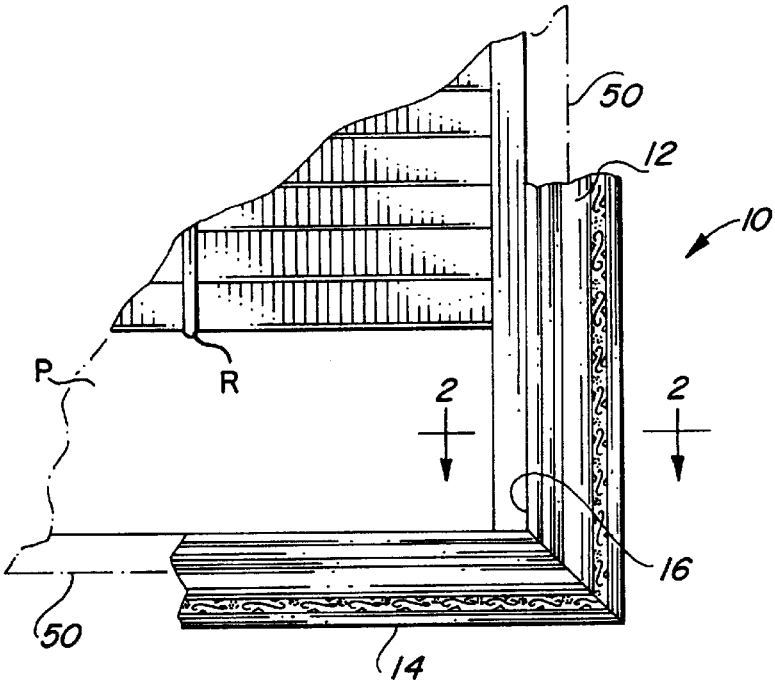
FIG. 1 is a partial front view of a shutter according to the present invention showing the outer frame and louver panel with the mounting surface of the opening shown in dotted lines.

Turning now to the drawings, particularly FIGS. 1 to 5, a shutter assembly according to the present invention as is shown as generally designated by the numeral 10. The shutter assembly has an exterior frame 12 which may be rectangular, but may be other shapes depending upon the requirements of the installation. FIG. 1 shows only a corner section of the frame. The frame 12 is shown having upper and lower horizontal sections 14 and opposite vertical side members 16. The sections 14 and sides 16 connect at their corners to form a complete frame 12. The frame extends around the periphery of the louver panels P and is attached to the panels by hinges H. Frame 12 may enclose one or more louver panels P.

Each frame member 14, 16 is preferably fabricated by extrusion from a suitable synthetic material such as polymeric material with polyvinyl chloride, polyethylene, polystyrene and polypropylene, being representative. The frame members are preferably fabricated with a coloring agent included in the resin and any desired exterior surface treatment may be applied in the molding process.

Figure 3:
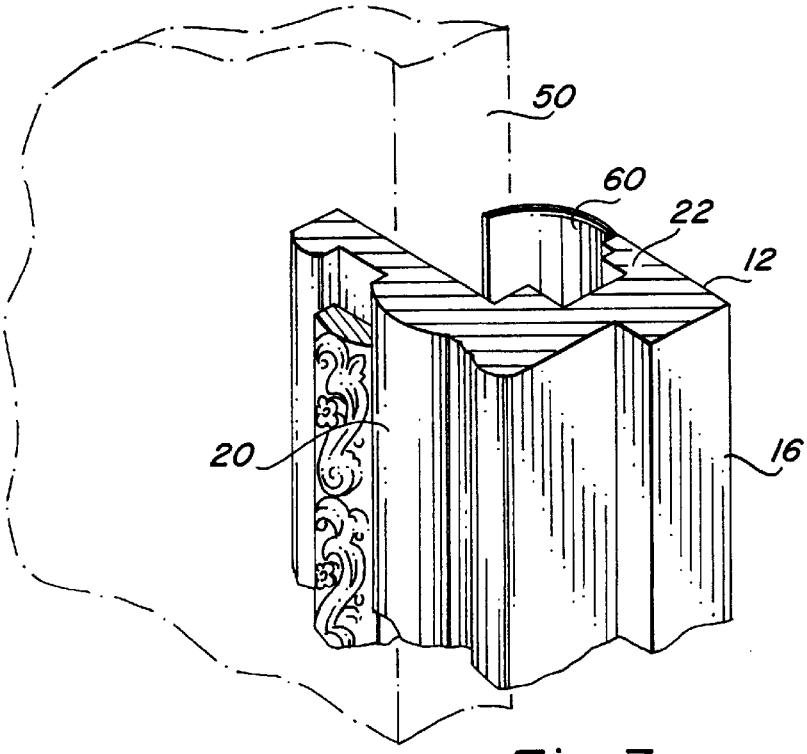
FIG. 3 is a perspective view of section a of the outer frame with the mounting surface of the opening shown in dotted lines.
Figure 2:
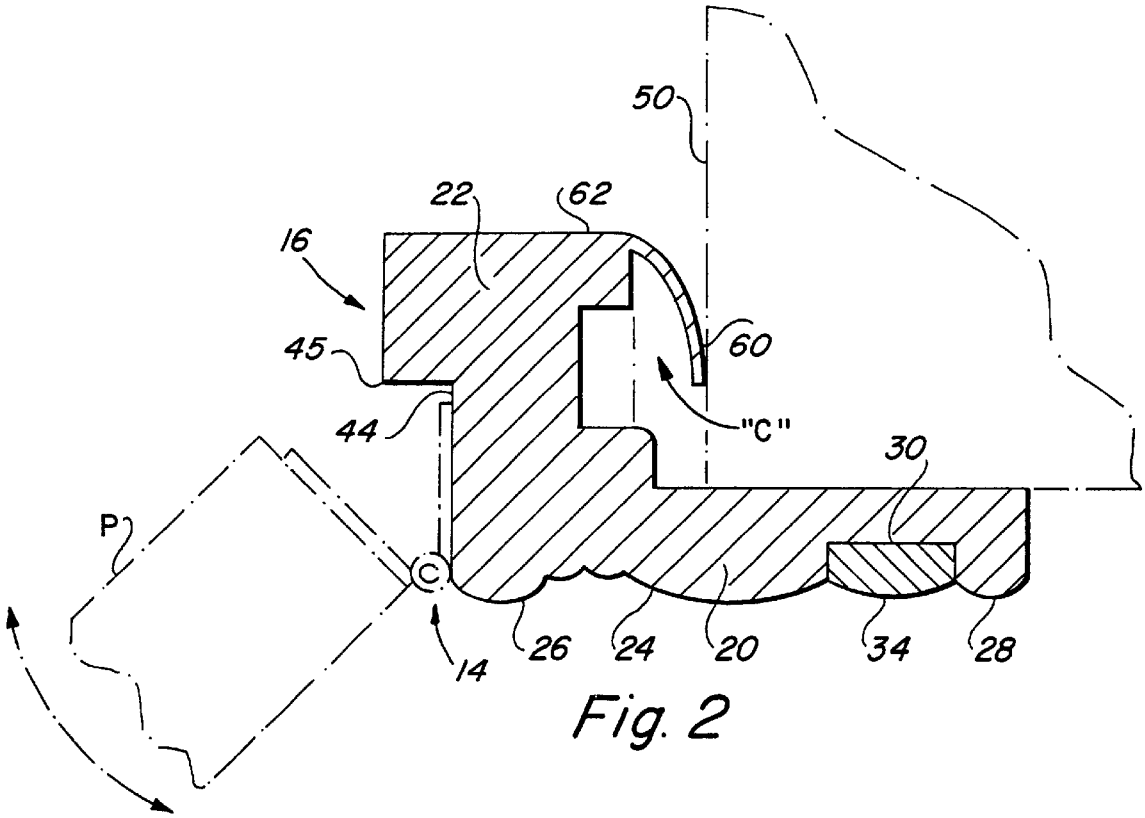
FIG. 2 is a cross-sectional view along line 2—2 of FIG. 1.

As best seen in FIGS. 2 and 3, the frame sections 14 and 16 are each generally L-shaped having a facing 20 and a rearwardly depending leg 22. In FIGS. 2 and 3 only frame section 16 is seen, it being understood that section 14 is similarly configured. The rearwardly depending leg 22 is at generally right angle with respect to facing 20. The facing 20 is shown as being provided with a decorative surface which may include any desired features such as a curved section 24 and raised beading 26 and 28.

Figure 4:
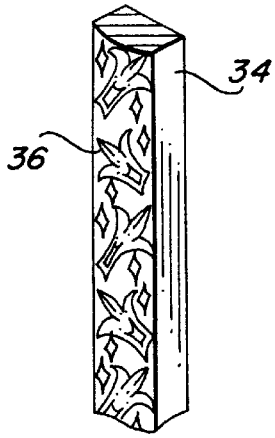
FIGS. 4 and 5 are perspective views of a representative insert strips which may be inserted into a recess in the outer frame.
Figure 5:
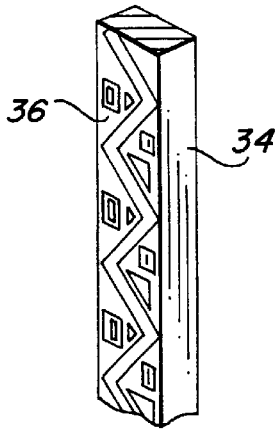

The facing 20 defines a channel 30 which is shown as extending generally longitudinally along the facing. The channel extends vertically in the surface of member 16 and extends horizontally in the upper and lower frame members 14. The channel may be variously dimensioned, and is typically one-half inch or so in width, and is adapted to receive insert 34, as seen in FIGS. 3 to 5. The insert 34 may be an extruded section of the same or similar material as the frame member having a cross-section shape conforming to the shape of the channel 30. The inserts have a decorative surface treatment 36. The decorative insert 34 can be inserted at the factory at the time of manufacture or may be inserted at the time of installation of the shutter in the opening. The insert may simply be pressed in place and frictionally retained or secured by an adhesive. An insert having a suitable selected decorative treatment may be selected by the user in accordance with the decor of the intended installation. Preferably the shutter manufacturer or installer will have a selection of inserts from which the user may select in accordance with decorative preferences. In this way, the user is provided a selection which will allow the user to customize or individualize the appearance of the shutter assembly. The insert 34 may be the same color as the shutter or may be provided in a contrasting color. As shown, the surface design 36 on the trim strip of FIG. 4 consists of a repetitive leaf and flower design and in FIG. 5 a geometric design is shown. It will be apparent that the insert and channel may be of various sizes and that various decorative features 36 of the insert can be provided. The inserts may be continuous around the frame or at selected locations.

The frame sections 14, 16 each have a rearwardly extending leg 22 which provides a mounting surface for the louver panel P. The individual louver panels P may be pivotted at hinges 14 and adjustable by centrally extending control rod R, as shown, or may be positional by gear rack or other mechanical means which may be contained within a recess in the stile. Reference is made to my prior U.S. Pat. No. 5,379,551 for a more complete description of louver adjusting systems. The louver panels are hinged to surface so that the panel P can swing outwardly as shown in dotted lines in FIG. 2. In the closed position, the louver panel assumes the position shown in FIG. 1 with the edge of the louver panel P hinged to surface 44 of rearwardly extending projection 22 of the frame. A shoulder 45 projects outwardly at the inner end of surface 44.

As pointed above, it is conventional that shutters assemblies are fabricated at a factory and then installed at the site. It is often necessary for the shutters to be cut-to-fit or trimmed at the installation site as the dimensions of the location to which the shutters are being installed may be subject to some variation. Referring to FIGS. 1 to 3, the opening 50 in which the shutter assembly is installed may not be entirely square. The opening 50 is typically a recess around a window or several windows. The surfaces 50 at the opposite side of the window opening may by slightly irregular or out-of-square. Accordingly, if the shutter frame 12 is manufactured to a precise dimension, it may be difficult to fit the shutter assembly into the opening 50 without cutting or trimming. Cutting and trimming is time consuming and also may result in damage to the frame with non-wood shutters. The extruded components 14, 16 have an outer smooth surface and are more porous and a more porous interior. Any trimming may peel away the finish surface revealing the more porous, less aesthetically appealing surface.

To provide versatility and flexibility in the installation process, the outer frame 12 of the present invention is provided with a flexible flap 60. As best seen in FIG. 2, the rearwardly extending projection 22 has a inwardly disposed flange 62 which at its inner end carries a flap 60 of flexible material. The flap 60 may be integrally formed as part of the extruded component or may be secured to flange 62 by a suitable adhesive.

It will be seen that when the frame members 14, 16 are placed in an abutting relationship with the mounting surface 50, the flexible flap 60 will assume a position engaging the edges of the opening 50. This allows the installer a clearance space designated by the letter C. Thus, the clearance space will accommodate dimensional variations and out of square irregularities in the recess 50 in which the shutter frame is to be installed. Further, the clearance space will allow the shutter frame to be squared in the opening without the necessity of having to trim or cut away a portion of the frame.

Figure 6:
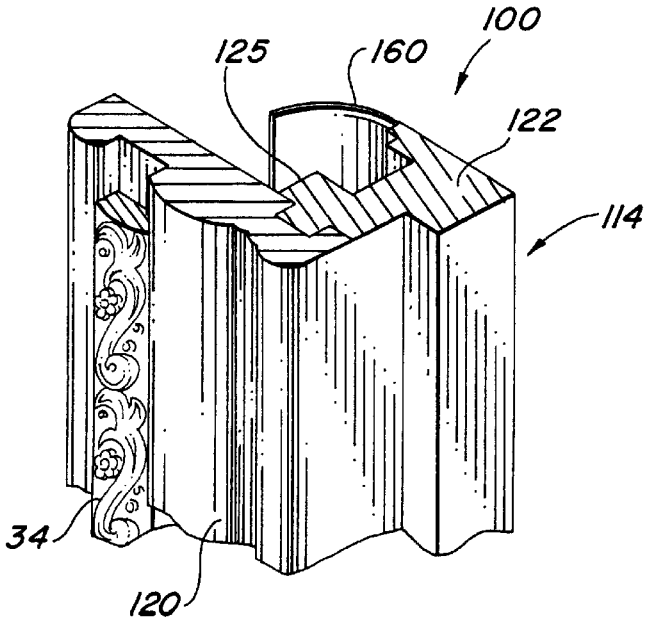
FIG. 6 is a perspective view illustrating an alternate embodiment of the exterior shutter frame member.

FIG. 6 shows yet another embodiment of the present invention designated by the numeral 100 in which a shutter frame component 114 has a facing 120 and a rearwardly, depending leg 122 forming a generally L-shaped member. A flexible flap 160 extends from the distal end of leg 122. In this embodiment, the leg 122 and facing 120 are separate components which are connected at a joint such as a dove tail 125. The facing 120 is provided a suitable decorative surface which may include a decorative insert 34 as described above. The facing may be extruded or fabricated by molding from a material such as a resin, plastic or plaster material. The facing 120, as well as the leg 122 which supports the louver panel, may also be milled from a material such as medium density fiberboard.

With the embodiment of FIG. 7, the frame members are preferably fabricated from several different materials. The material of leg 122 is a stronger material as it supports the panel P and the decorative facing is another material which is less expensive and which permits easier inclusion of decorative features. The frame 14, 16 is assembled by joining the components at the joint 125 by use of adhesive or other conventional joining techniques.

It will be obvious to those skilled in the art to make various changes, alterations and modifications to the invention described herein. To the extent such changes, alterations and modifications do not depart from the spirit and scope of the appended claims. They are intended to be encompassed therein.

I claim:

1. A window shutter assembly positionable about an opening having a front surface and a rearwardly extending edge comprising:

(a) an exterior frame having a frame section to be placed about the opening;

(b) said frame section having a facing section and a rearwardly extending leg, said facing having a surface of a predetermined width extending from an inner end and abutting said front surface of said opening, said leg extending along said edge of said opening in an installed position;

(c) a flexible member extending from said leg, said flexible member having an inner end generally aligned with the inner end of said surface and having a width less than the width of the abutting surface against which said frame section may be adjustably positioned with respect to said opening; and (d) said flexible member in an installed position engaging said edge to form a seal.

2. The window shutter assembly of claim 1 wherein said frame and flexible member are extruded as a unitary section.

3. The window shutter assembly of claim 1 wherein said facing section and said leg are separate components joined at a connection.

4. The window shutter assembly of claim 3 wherein said facing section and said leg are different materials.

* * * * *